US009527644B2

(12) United States Patent
Schürrle et al.

(10) Patent No.: US 9,527,644 B2
(45) Date of Patent: Dec. 27, 2016

(54) DEVICE FOR TRANSPORTING AND INSTALLING A COMPRESSOR

(71) Applicants: Karl Schürrle, Dürrwangen (DE); Jörg Christopher Stapf, Uttenreuth (DE)

(72) Inventors: Karl Schürrle, Dürrwangen (DE); Jörg Christopher Stapf, Uttenreuth (DE)

(73) Assignee: SIEMENS HEALTHCARE GMBH, Erlangen (DE)

( * ) Notice: Subject to any disclaimer, the term of this patent is extended or adjusted under 35 U.S.C. 154(b) by 290 days.

(21) Appl. No.: 13/764,818

(22) Filed: Feb. 12, 2013

(65) Prior Publication Data

US 2013/0213830 A1 Aug. 22, 2013

(30) Foreign Application Priority Data

Feb. 17, 2012 (DE) ..... 10 2012 202 461

(51) Int. Cl.

| | |
|---|---|
| ***B65D 81/00*** | (2006.01) |
| ***B65D 19/02*** | (2006.01) |
| ***B65D 19/42*** | (2006.01) |
| ***B66F 7/16*** | (2006.01) |

(52) U.S. Cl.

CPC ..... *B65D 81/00* (2013.01); *B65D 19/02* (2013.01); *B65D 19/42* (2013.01); *B66F 7/16* (2013.01); *B65D 2519/00661* (2013.01); *B65D 2519/00781* (2013.01); *B65D 2519/00786* (2013.01); *B65D 2519/00805* (2013.01); *B65D 2519/00855* (2013.01)

(58) Field of Classification Search

CPC ..... B65D 19/36; B65D 2585/6875; B65D 2585/688; B65D 2588/12; B65D 7/26;B65D 81/00; B65D 90/0033; B65D 85/68; B65D 2519/00805; B65D 2519/00661; B65D 2519/00781; B65D 2519/00855; B65D 2519/00786; B66F 3/24; B66F 9/12; B66F 5/0036

USPC ..... 108/11; 206/216, 223; 254/93 R; 410/24, 410/58

See application file for complete search history.

(56) References Cited

U.S. PATENT DOCUMENTS

| | | | | |
|---|---|---|---|---|
| 2,868,406 | A * | 1/1959 | Kookogey | 220/7 |
| 3,235,106 | A * | 2/1966 | Diehl | 414/429 |
| 3,289,868 | A * | 12/1966 | Miller et al. | 254/45 |
| 3,295,881 | A * | 1/1967 | Worthington | 414/542 |
| 3,499,694 | A * | 3/1970 | Coppell | 312/35 |
| 4,221,529 | A * | 9/1980 | DeShano | 414/546 |
| 4,343,401 | A * | 8/1982 | Paulyson | 206/577 |
| 5,468,116 | A * | 11/1995 | Reichert et al. | 414/607 |
| 5,595,465 | A * | 1/1997 | Knott | 410/24 |

(Continued)

FOREIGN PATENT DOCUMENTS

| | | |
|---|---|---|
| DE | 29600677 U1 | 3/1996 |
| DE | 202007006355 U1 | 7/2008 |
| DE | 202007019041 U1 | 5/2010 |

*Primary Examiner* — Joseph J Hail
*Assistant Examiner* — Jamal Daniel

(57) ABSTRACT

A device for transporting and installing a compressor is provided. The device includes a container serving to receive the compressor, with at least one removable planar side element, as well as a multipart lifting device which may be disassembled into its individual parts for transportation, and may be arranged in the container and after assembling the individual parts is designed such that the compressor may be fastened to the lifting device and may be lifted by means of the lifting device.

17 Claims, 8 Drawing Sheets

(56) References Cited

U.S. PATENT DOCUMENTS

| | | | | |
|---|---|---|---|---|
| 6,155,770 | A * | 12/2000 | Warhurst | 414/498 |
| 6,170,141 | B1 * | 1/2001 | Rossway | B64F 5/0036 206/319 |
| 6,203,270 | B1 * | 3/2001 | Magoshi | 415/126 |
| 7,604,134 | B2 * | 10/2009 | Lichinchi | 212/175 |
| 8,833,776 | B2 * | 9/2014 | Boulanger et al. | 280/35 |
| 2006/0153656 | A1 * | 7/2006 | Clive-Smith | 410/24 |
| 2007/0020059 | A1 * | 1/2007 | Rapeli | 410/24 |
| 2007/0163982 | A1 * | 7/2007 | Lichinchi | 212/175 |
| 2007/0189872 | A1 * | 8/2007 | Omuta | 410/24 |
| 2008/0223805 | A1 * | 9/2008 | Lichinchi | 212/175 |
| 2009/0261112 | A1 * | 10/2009 | Kondo | 220/629 |
| 2009/0266275 | A1 * | 10/2009 | Feeney | B64F 5/0036 108/55.1 |
| 2010/0258774 | A1 * | 10/2010 | Stokes | B66F 3/28 254/89 R |
| 2014/0054303 | A1 * | 2/2014 | Fjetland | 220/629 |
| 2015/0113805 | A1 * | 4/2015 | Conger | F01D 25/24 29/888 |
| 2015/0114004 | A1 * | 4/2015 | Conger | F01D 25/28 60/796 |

* cited by examiner

DEVICE FOR TRANSPORTING AND INSTALLING A COMPRESSOR

CROSS REFERENCE TO RELATED APPLICATIONS

This application claims priority of German application No. 102012202461.1 DE filed Feb. 17, 2012. All of the applications are incorporated by reference herein in their entirety.

FIELD OF INVENTION

A device for transporting and installing a compressor is provided, in particular, for a cooling circuit of a magnetic resonance tomograph.

BACKGROUND OF INVENTION

Magnetic resonance tomographs are used in many applications in medicine for diagnosing different diseases. Magnetic resonance tomographs which have superconducting components which are cooled, in particular, by means of liquid helium may be derived from the prior art. By way of example, a superconducting wire of a magnet system of the magnetic resonance tomograph is arranged in a tank of liquid coolant, in particular helium. The coolant absorbs heat when the superconducting component is cooled and is thus transferred into the gaseous phase. In order to transfer the helium gas thus produced into the liquid state again, a cooling head is immersed in the helium tank. Highly compressed helium gas in said cooling head is decompressed to produce low temperatures, and compressed again via a second circuit by means of a compressor.

Accordingly, a cooling circuit of the magnetic resonance tomograph has a compressor which is used to compress gaseous coolant, in particular helium. In this case, the compressor is typically arranged in a service chamber of the magnetic resonance installation. Said service chamber is often very narrow and difficult to access, so that when replacing the compressor as a result of a fault or due to maintenance, said compressor being able to weigh up to 130 kg, this may result in problems when positioning or lifting the compressor due to the restricted space.

Various types of transport containers are known from the prior art.

Thus, a transport and packing container which is able to be disassembled is disclosed in the German utility model DE 20 2007 019 041 U1, said container consisting of removable bottom parts and top parts with peripheral webs arranged vertically thereon as well as side and front walls which may be erected on the bottom plate along the peripheral webs. The flexible arrangement of the side and front walls when packaging and/or unloading the goods to be transported makes it possible to erect only some of the side and front walls so that easy access to the container is ensured.

The German utility model DE 296 00 677 U1 discloses a closable transport box in which a foldable hand cart is arranged in order to ensure that the box is able to be transported at all times. The transport box substantially consists of a box body and a closable box lid pivotably mounted thereon, wherein side walls are arranged on the box lid such that it is able to receive the hand cart in the folded-up state. Moreover, an intermediate lid is provided, said intermediate lid being pivotably mounted on the side wall of the box lid via which the box lid is mounted on the box body, so that the intermediate lid is able to close the receiving space of the box lid in which the foldable hand cart is accommodated. For transporting the box, therefore, after opening the box lid and the intermediate lid, the folded-up hand cart may be removed, and after being folded out, said hand cart ensures that the box is able to be easily transported.

SUMMARY OF INVENTION

Proceeding from this prior art, it is an object to specify an improved device for transporting and installing the compressor which, in particular, facilitates replacement required by maintenance.

The object is achieved by a device of the type cited in the introduction, the device having a container serving to receive the compressor, with at least one removable side element as well as a multipart lifting device which is able to be disassembled into its individual parts for transportation and is able to be arranged in the container and after assembling the individual parts is designed such that the compressor may be fastened to the lifting device and may be lifted by means of the lifting device.

The divisible container is a standard packaging unit which is suitable for all common types of compressor and serves both for delivering the new compressor and returning the replaced compressor. Thus, in a particularly advantageous manner, packaging material is saved and the costs associated therewith reduced. Moreover, the device for transporting and installing provides a multifunctional concept for the replacement of compressors, which permits the compressor to be able to be replaced by a single maintenance person. Thus, in particular, the lifting device which comprises a plurality of parts and is transported in the container in the disassembled state together with the compressor serves, when installing the compressor, in particular for lifting the compressor onto a rolling truck or the like. The lifting device is able to be constructed locally in the service chamber, so that introducing a potentially bulky lift truck into a service chamber which is difficult to access is avoided. Thus, in particular, the compressor may be lifted by means of the lifting device onto a rolling truck, the outer dimensions thereof being optimally adapted to the outer dimensions of the compressor, so that minimal space is required when maneuvering inside the service chamber.

The container provided for transporting the compressor is divisible and has the at least one removable side element. Preferably, a plurality of side elements of the container are removable, wherein for removing the compressor from the substantially cuboidal container, the side elements laterally defining the compressor and the side element arranged at the top are dismantled from the side element arranged on the bottom, on which the compressor stands. By means of the lifting device, the compressor is able to be lifted from the side element forming the bottom surface of the container, so that said side element is able to be easily replaced by the rolling truck which is pushed under the compressor.

In an embodiment, the at least one side element of the container, in particular the side element forming the bottom surface of the container, has a reduced-friction surface coating. When replacing the compressor, the reduced-friction surface coating is used to slide the compressor to be replaced in a simple manner, in particular from a cabinet base which is typically manufactured from metal, onto the side element. The remaining side elements of the container may be subsequently assembled so that the container is able to serve for the return transport of the used compressor.

The reduced-friction surface coating may consist of Teflon (polytetrafluoroethylene), which is characterized by reduced abrasion and thus is suitable for replacing a plurality of compressors. It is a drawback that commercially available compressors for magnetic resonance tomographs are of different sizes, in particular relative to a longitudinal axis of the compressor. In order to permit a standardized transportation concept, it is provided that at least one bracket for fixing the compressor is arranged inside the container, said bracket being able to be adjusted along a predetermined axis and being able to be locked in position. The bracket is able to be locked in position in a plurality of positions, so that different types of compressor may be fixed by the bracket. This ensures secure transportation of the compressor arranged in the container and thus may contribute to preventing damage to the compressor caused by transportation.

In an embodiment, it is provided that at least one further bracket which is able to be adjusted and locked in position is arranged inside the container so that the compressor is able to be locked in a predeterminable position relative to the predetermined axis and/or additionally relative to a further axis extending perpendicular to the predetermined axis. Thus it is possible, in particular, to fix the compressor centrally in the container, said compressor, in particular, potentially having a weight of more than 100 kg. This has the advantage that the weight is evenly distributed, so that handling of the container during transportation is facilitated and tilting is eliminated.

According to exemplary embodiments, it is provided that the bracket and/or the further bracket is displaceably mounted on the container. The bracket and/or the further bracket is thus connected to the container and may accordingly be displaced along the predetermined axis and/or relative to the further axis extending perpendicular thereto, in order to fix the compressor. For locking the bracket in position, conventional plug connections, latching connections and/or clamping connections are used which are sufficiently known in the prior art and do not require further description. Alternatively, the bracket and/or the further bracket, in particular the further bracket forming the abutment for the displaceable bracket, is fixedly connected to one of the side elements of the container.

Alternatively or additionally, it is provided that the compressor and/or parts of the multipart lifting device which are arranged in the container for transportation, are fixed in the container by means of releasable securing means, in particular clamping blocks, straps and/or screw connections. Accordingly, the container is provided with screw threads for receiving the screw connections and/or eyes for fixing the strap, so that the compressor and/or the parts of the multipart lifting device may be fixed in the container. This increases the security when transporting the compressor and reduces the risk of damage during transportation.

In an exemplary embodiment, a plurality of roller elements are arranged on the container, in particular on the side element forming the bottom surface of the container. This permits easy displacement of the container, in particular inside the service chamber, by a single maintenance person, without an additional lift truck being necessary. The compressor and the lifting device may be easily transported whilst still in the packaged state to a suitable point inside the service chamber and then installed.

In an exemplary embodiment, it is provided that the roller elements are arranged on the at least one removable side element, so that said side element may be used as an additional rolling truck, for example for transporting the compressor to be replaced. Advantageously, the side element provided for replacing the compressor, which has the reduced-friction surface coating, is provided with roller elements so that said side element serves as an additional rolling truck.

Preferably, at least one of the roller elements is pivotably mounted in order to increase the maneuverability of the container and/or the compressor arranged on the side element forming the rolling truck.

In one development, it is provided to equip the container with two handle elements which may be extended or folded out and which permit a maintenance person to tilt the container relative to its vertical alignment by lifting. Advantageously, at least two roller elements are provided at the bottom of the container on which the tilted container rests. The container may be displaced in this tilted state—in a manner similar to a push cart—which, in particular, may be performed by a single person without a great deal of effort.

The multipart lifting device which, together with the compressor, is transported in the container comprises two hydraulic lifts, in particular oil pressure lifting systems, and a multipart support frame which is disassembled into its individual parts for transportation. In the mounted state, the support frame of the lifting device is arranged between the hydraulic lifts such that the compressor fastened to the support frame may be lifted and/or lowered in the vertical direction.

Moreover, the lifting device comprises at least one fastening device which may be releasably attached to the support frame and serves for fastening the compressor to the support frame. In this case, the fastening device may be of universal configuration so that said fastening device is suitable for fastening to different types of commercially available compressor. Alternatively, the fastening device transported in the container is accordingly adapted to the type of compressor transported.

Preferably, the at least one fastening device may be adjusted along the support frame. In this case, for example, the support frame may have a recess which extends over at least one portion of the support frame and is suitable for receiving a clamping screw which connects the fastening device to the support frame. The adjustable arrangement of the fastening device on the support frame permits the use of the lifting device for lifting compressors, which differ in particular with regard to the arrangement of retaining eyes or the like which are provided for connecting to the fastening device. The device is thus suitable for installing different types of commercially available compressor.

Additionally, it is provided to configure the at least one fastening device to be longitudinally adjustable, so that the position of the fastening device may be adapted in a direction extending perpendicular to the support frame. In a particularly advantageous manner, this further increases the compatibility of the lifting device for installing different compressors of different designs.

Accordingly, it is provided that a linear or angled extension arm may be fastened to the at least one fastening device which, in particular, makes it possible to engage in a retaining eye arranged on the compressor or on the compressor housing at the side and/or at the bottom, so as to be fastened therein.

Preferably, the support frame has a plurality of fastening devices, in particular three or four, able to be adjusted in a horizontal plane, so that reliable fastening of the compressor and/or the compressor housing to the support frame is ensured.

BRIEF DESCRIPTION OF THE DRAWINGS

Further advantages and details are described hereinafter with reference to exemplary embodiments and with reference to the drawings, in which.

DETAILED DESCRIPTION OF INVENTION

Figure 1:
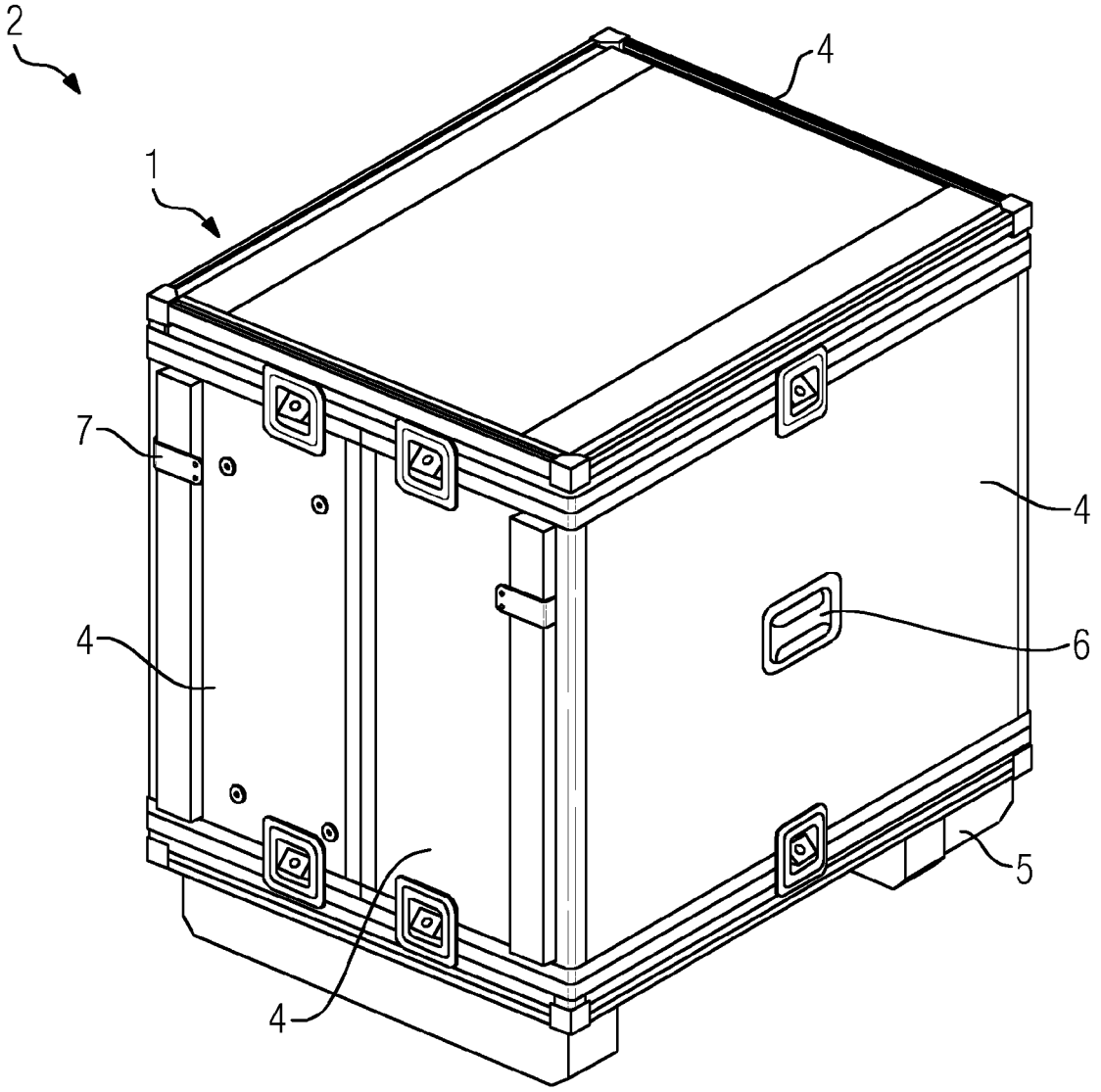
FIG. 1 shows a container of a device for transporting and installing a compressor in a perspective view.

FIG. 1 shows in a perspective view a container 1 of a device 2 for transporting and installing a compressor 3 which is provided, in particular, for a cooling circuit of a magnetic resonance tomograph. The container 1 has a cuboidal shape and has a plurality of planar side elements 4 which are releasably connected together. The side element 4 forming the bottom surface of the container 1 and arranged on the bottom face is mounted on blocks 5 so that the side element 4 forming the bottom surface of the cube is spaced apart from the floor in the vertical direction and it is possible for a lift truck to drive under the container 1 and to be engaged thereunder. For transporting the container 1, handles 6 which may be folded out are arranged on said container.

Figure 2:
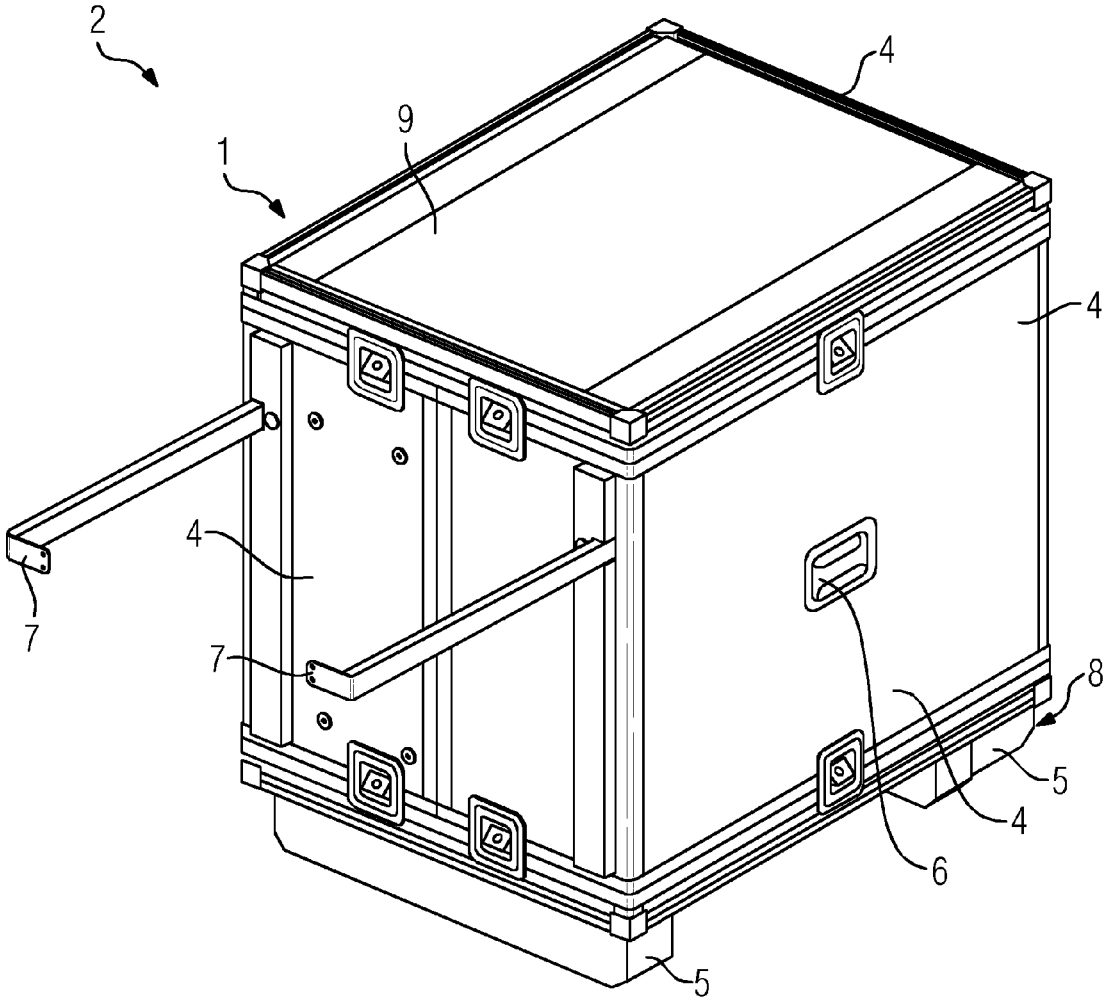
FIG. 2 shows the container with the handle elements extended.

The container 1 has two extendable handle elements 7, as shown in the perspective view of FIG. 2, which in the extended state serve for the transportation of the container 1. To this end, it is provided to lift the container 1 by means of the handle elements 7 in order to tilt said container relative to a vertical direction, so that it rests on roller elements 8 arranged on the bottom face of the container 1. The tilted container 1 may then be moved forward in the manner of a push cart which, in particular, permits the transportation of the container 1 with the parts arranged therein by a single person.

The side element 4 arranged on the top face which forms the cover of the container 1 has a reduced-friction surface coating 9. When replacing a compressor, said surface coating is used so as to be able to push the compressor to be replaced easily onto the side element 4 forming the cover of the container 1.

Figure 3:
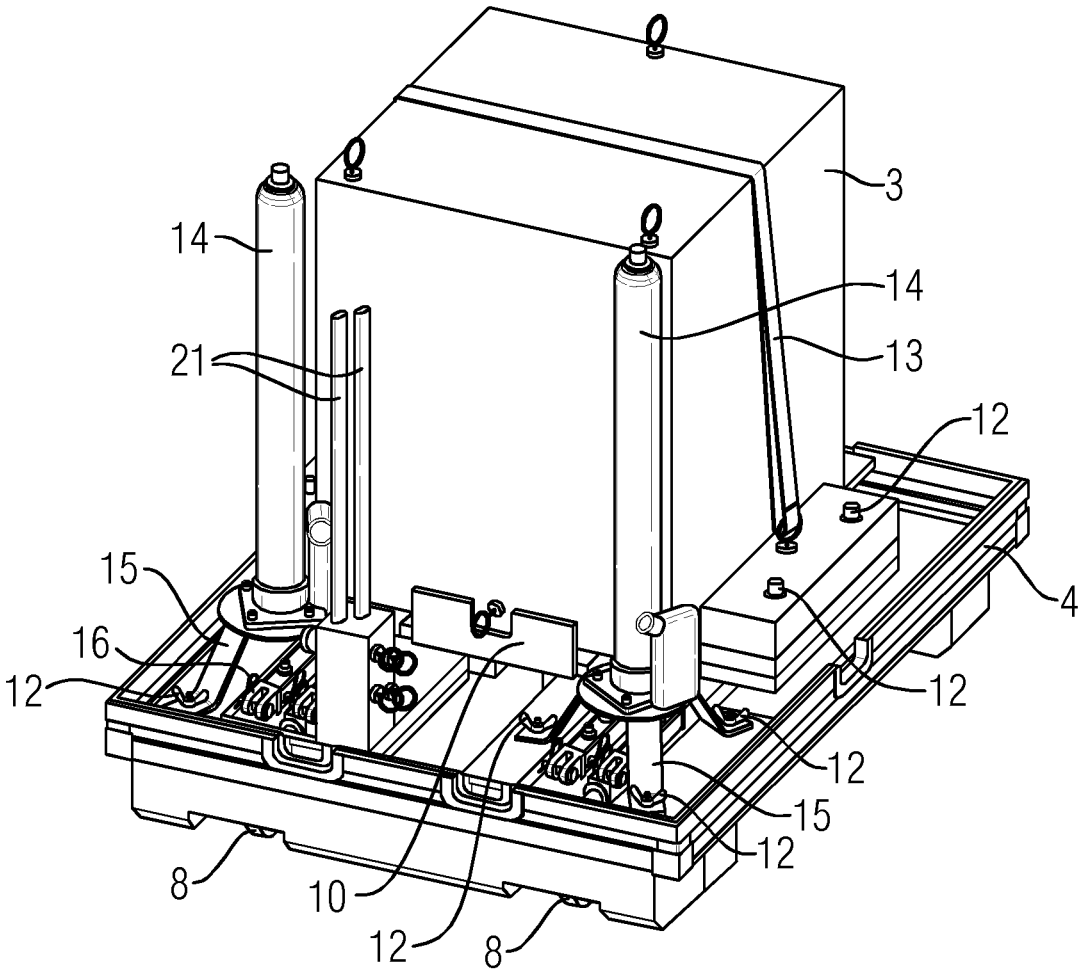
FIG. 3 shows a compressor and a hydraulic lift of a lifting device which are fastened to a side element forming the bottom surface of the container, in a perspective view.

FIG. 3 shows the container 1 in the disassembled state, all removable side elements 4 having been removed so that the view of the parts previously arranged in the container 1 is exposed. The compressor 3 is fastened to the side element 4 forming the bottom surface of the container 1. To this end, a bracket 10, which is displaceably mounted on the side element 4 and which fixes the position of the compressor 3 relative to an axis, is locked in position. Relative to a further axis extending perpendicular thereto, the position of the compressor 3 is fixed by means of opposingly arranged clamping blocks 11. The clamping blocks 11 are fastened by means of securing means configured as screw connections 12 to the side element 4 forming the bottom surface of the container 1. A strap 13 additionally fixes the position of the compressor 3. In the exemplary embodiment shown here, the strap 13 is fastened to eyes of the clamping blocks 11.

Moreover, two hydraulic lifts 14 which in the example shown here are configured as oil pressure lifting systems, are releasably fastened to the side element 4 by means of screw connections 12. Each hydraulic lift 14 has a tripod 15 which is used both when installing the hydraulic lifts 14 and when fastening the hydraulic lifts 14 to the side element 4. For the latter usage, the tripod 15 has corresponding recesses suitable for receiving fastening means, in particular screws.

During transportation, moreover, lever rods 21 are arranged in the container 1, said lever rods being provided for actuating the hydraulic lifts 14. Moreover, the device 2 comprises fastening devices 16 for installing and for transporting the compressor 3 and a multipart support frame 17, not shown in FIG. 3 in any more detail.

Figure 4:
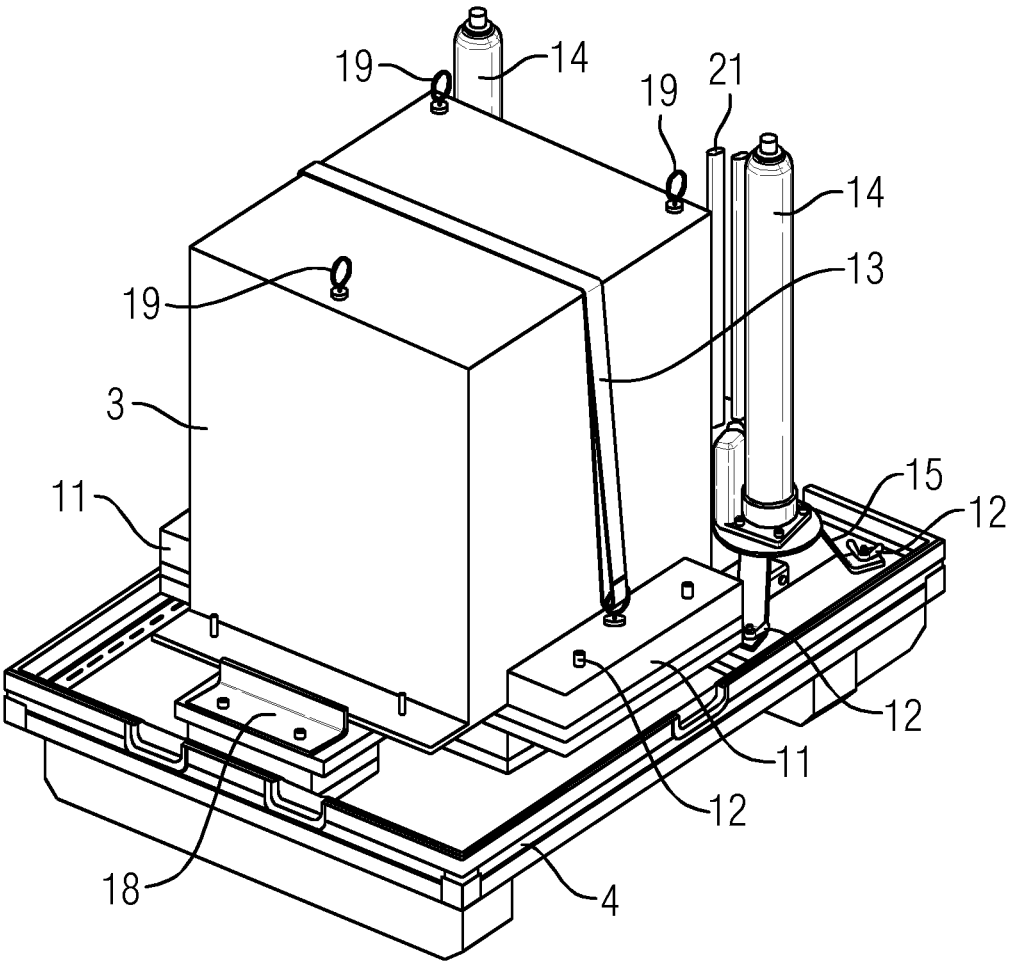
FIG. 4 shows a further perspective view of the components fastened to the side element which comprise the compressor and the hydraulic lifts.

FIG. 4 shows a further perspective view of the components of the device 2 fastened to the side element 4 forming the bottom surface of the container 1. A further bracket 18 fixedly connected to the side element 4 is clearly seen, said further bracket serving as an abutment for the bracket 10 and for fixing the compressor 3 relative to the axis corresponding to the longitudinal extent of the container 1. The two clamping blocks 11 which are fixed to the side element 4, fix the position of the compressor 3 relative to the further axis extending perpendicular to the axis. The compressor 3 has retaining eyes 19 which are connected to the fastening devices 16 when the compressor 3 is intended to be lifted by means of the lifting device 20.

Figure 5:
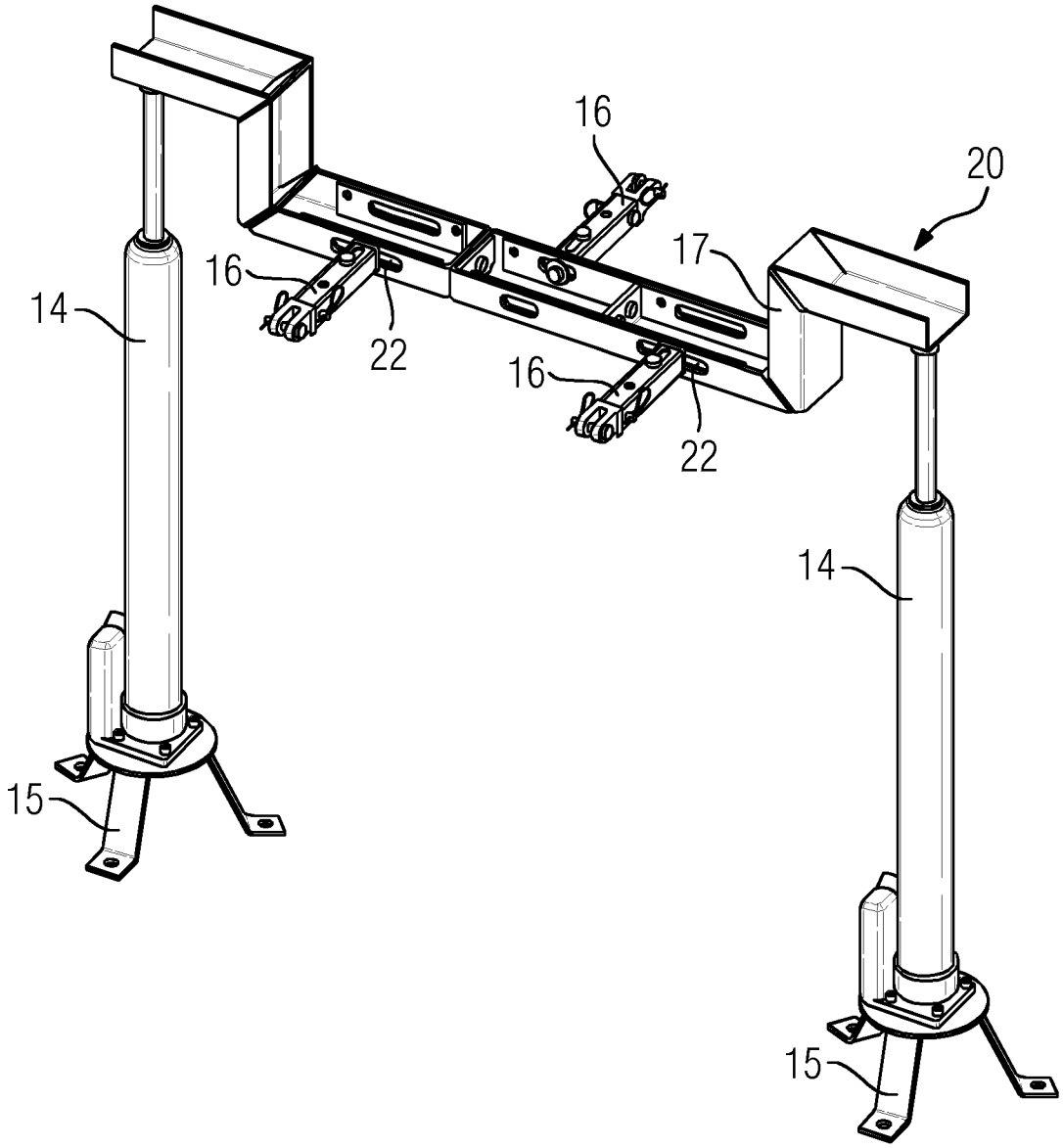
FIG. 5 shows the lifting device in the mounted state according to a first exemplary embodiment.

FIG. 5 shows the lifting device 20 of the device 2 according to a first exemplary embodiment. The lifting device 20 has the multipart support frame 17 which in the mounted state has a stepped profile, which permits a removal of the compressor 3 from the container 1 even when the side elements 4 are only partially removed.

Three fastening devices 16 are releasably fastened to the support frame 17, said fastening devices being held by means of corresponding screw connections in elongate recesses 22 which extend over at least one region of the support frame 17. The position of the fastening devices 16 along the support frame 17 is thus predeterminable so that the fastening devices 16, which are provided for fastening to the retaining eyes 19 of the compressor 3, are adjustable along the support frame 17. This permits the fastening of compressors 3 of different designs to the lifting device 20. Moreover, the fastening devices 16 may be adjusted in their length, so that even retaining eyes 19 which are spaced apart at variable intervals in a direction extending perpendicular to the longitudinal extent of the support frame 17 may be reached by the fastening devices 16.

Figure 6:
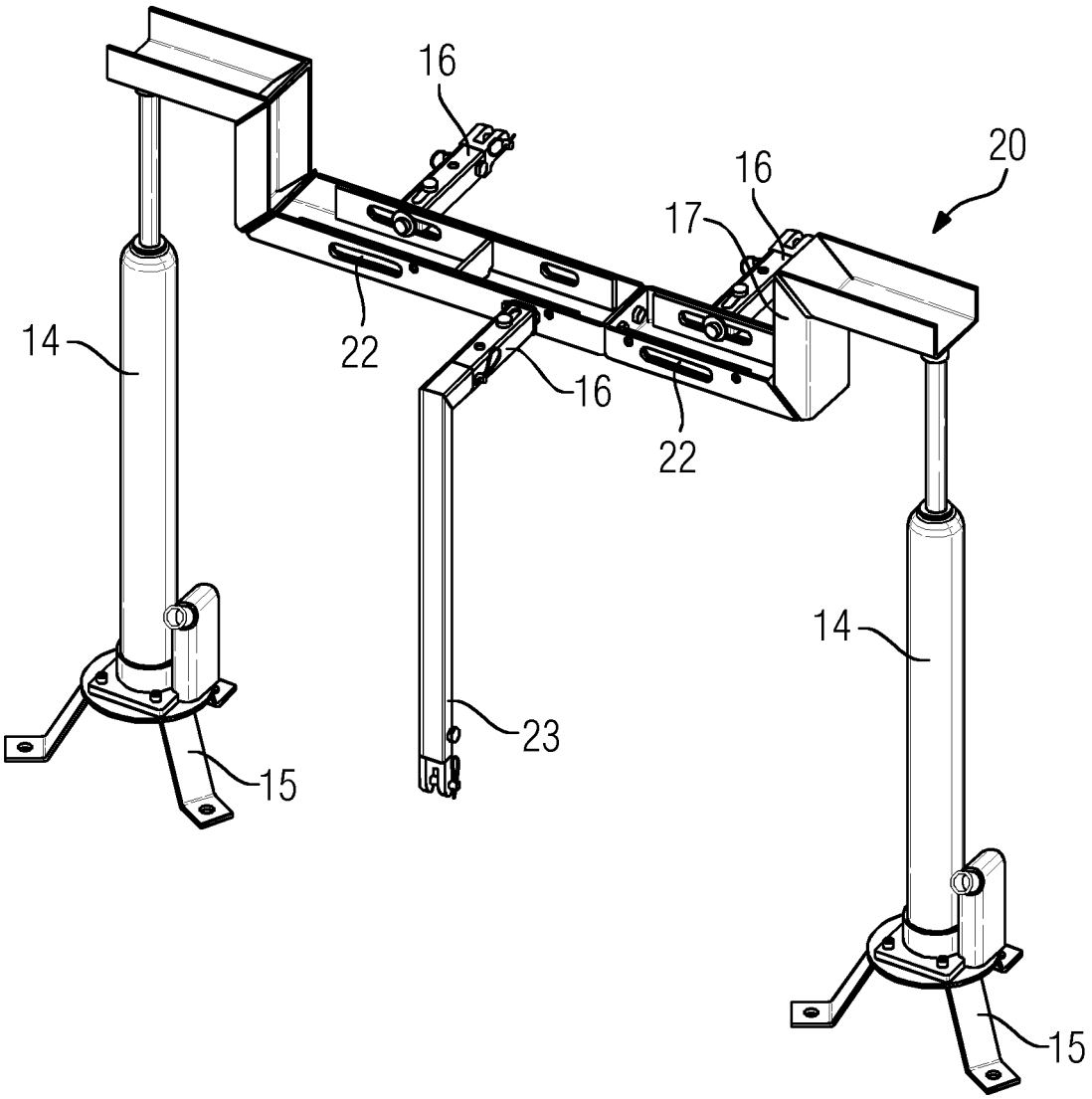
FIG. 6 shows the lifting device in the mounted state according to a second exemplary embodiment.

FIG. 6 shows the lifting device 20 according to a second exemplary embodiment. In this case, an extension arm 23 is fastened to one of the fastening devices 16, said extension arm being provided for connecting to a retaining eye 19 of the compressor 3, which is arranged at the bottom of the compressor 3 to be lifted. To this end, the extension arm 23 has an angled shape.

Figure 7:
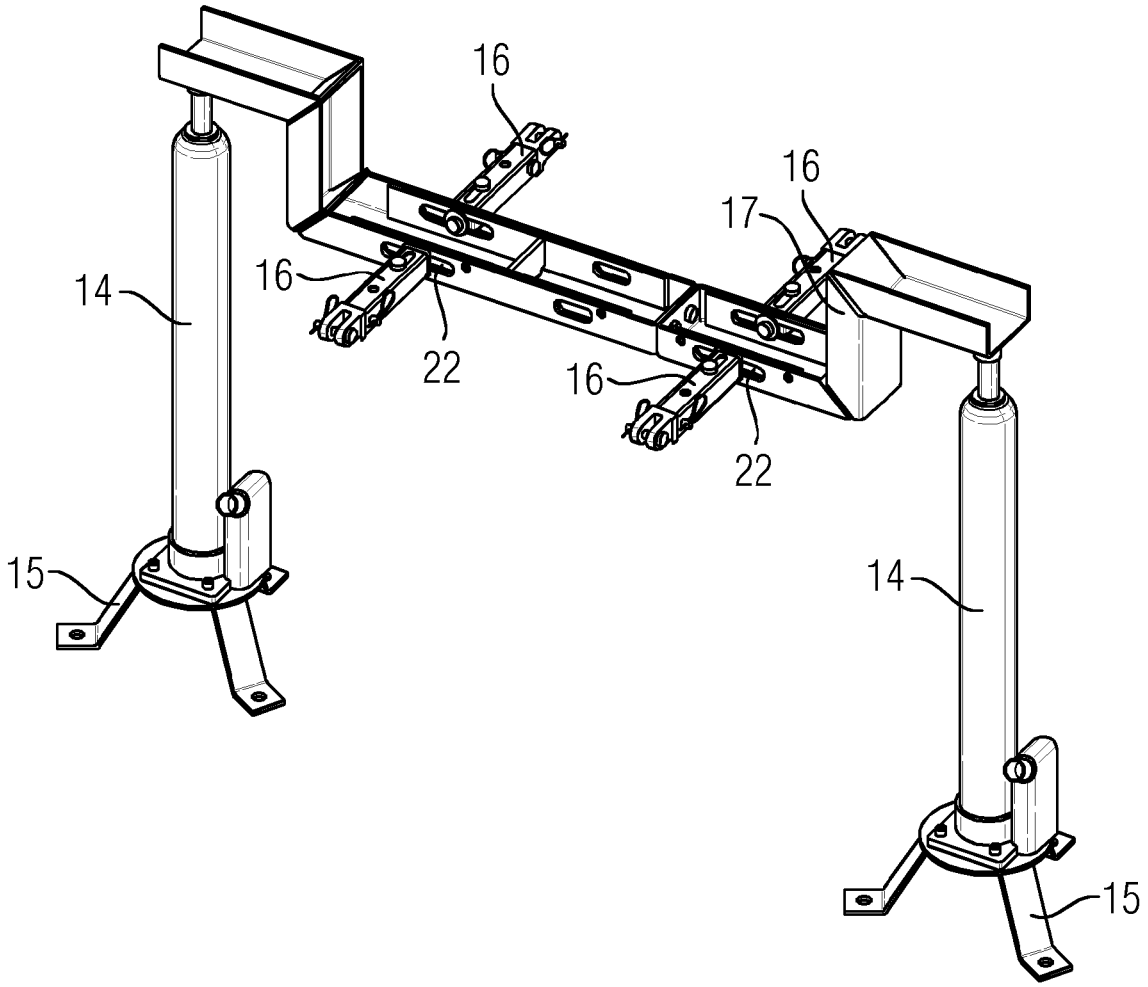
FIG. 7 shows the lifting device according to a third exemplary embodiment.

FIG. 7 shows in a further perspective view a third embodiment of the lifting device 20. In this case, four fastening devices 16 are provided, arranged adjustably along the support frame 17, said fastening devices being configured to be connected to retaining eyes 19. It goes without saying that the exemplary embodiments shown in FIGS. 4-7 substantially correspond to one another. In particular, it is provided that the fastening devices 16 are provided adjustably on the support frame 17, each fastening device 16 being longitudinally adjustable, so that an adjustment in a horizontal plane is possible.

Figure 8:
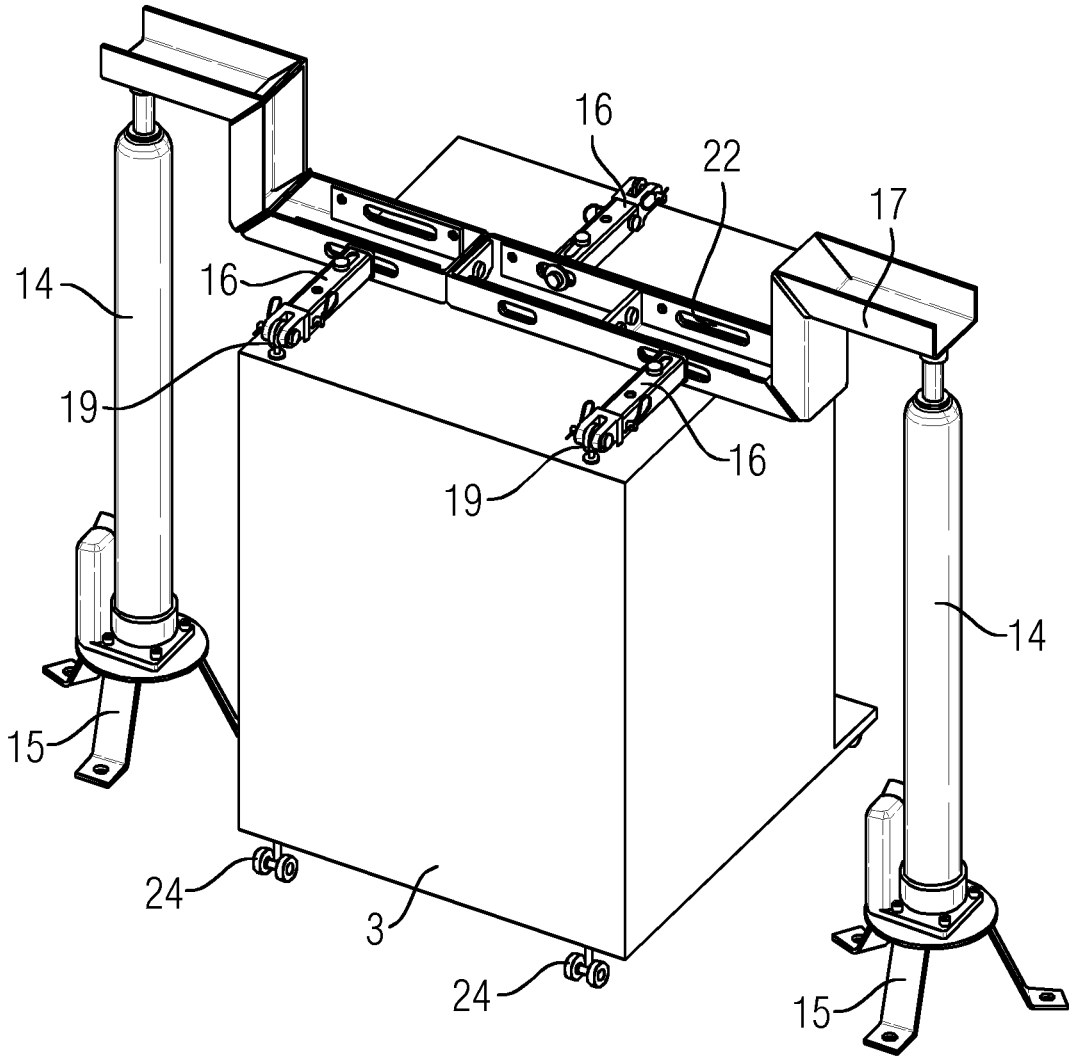
FIG. 8 shows by way of example the lifting device of the first exemplary embodiment with the compressor fastened thereto in a perspective view.

FIG. 8 shows by way of example a compressor 3 which is lifted by means of the lifting device 20 of the first exemplary embodiment shown in FIG. 5. In the example shown here, the compressor 3 itself has further roller elements 24 which facilitate the transportation.

A replacement of a faulty compressor or a replacement required by maintenance may, for example, take place by the container 1, which contains the compressor 3 intended as the replacement and the remaining parts of the device 2 for installing the compressor 3, being initially positioned at a suitable point inside a service chamber. Then the side elements 4 of the divisible container 1 are removed so that an arrangement as shown in FIGS. 3 and 4 may be seen. The side element 4 forming the cover of the container 1, and which has the reduced-friction surface coating 9 and roller elements 8, is used to transport the compressor to be replaced. To this end, the reduced-friction surface coating 9 which in this case consists of Teflon (polytetrafluoroethylene) permits the particularly easy sliding of the compressor to be replaced onto the side element 4. The lifting device 20 is used for installing the compressor 3, wherein the fastening devices 16 are connected to corresponding retaining eyes 19 of the compressor 3. According to the arrangement and alignment of the retaining eyes 19 on the compressor 3, the fastening devices 16 are arranged along the support frame 17 and/or the length of the respective fastening device 16 is adjusted.

We claim:

1. A device for transporting and installing a compressor, comprising:

a container serving to receive the compressor;

a removable planar side element; and a multipart lifting device which is able to be disassembled into a plurality of individual parts for transportation and is able to be arranged in the container, wherein the plurality of individual parts are assembled to construct the lifting device such that the compressor is fastened to the lifting device and is lifted by means of the lifting device, wherein the container comprises a pair of extendable handles that are configured to tilt the container relative to a vertical direction, wherein the lifting device comprises two hydraulic lifts that are releasably fastened to the side element of the container, wherein in the assembled state, the lifting device is not fastened to the side element of the container wherein a multipart support frame is arranged between the hydraulic lifts when the lifting device is mounted, and wherein a fastening device is releasably attached to the support frame and configured to fasten the compressor to be lifted by the lifting device.

2. The device as claimed in claim 1, wherein the side element has a reduced-friction surface coating.

3. The device as claimed in claim 2, wherein the reduced-friction surface coating consists of polytetrafluoroethylene.

4. The device as claimed in claim 1, wherein a bracket for fixing the compressor is arranged inside the container, the bracket being able to be adjusted along a predetermined axis and able to be locked in position.

5. The device as claimed in claim 4, wherein a further bracket which is able to be adjusted and locked in position is arranged inside the container so that the compressor is able to be locked in a predeterminable position relative to the predetermined axis and additionally relative to a further axis extending perpendicular to the predetermined axis.

6. The device as claimed in claim 4, wherein a further bracket which is able to be adjusted and locked in position is arranged inside the container so that the compressor is able to be locked in a predeterminable position relative to the predetermined axis or additionally relative to a further axis extending perpendicular to the predetermined axis.

7. The device as claimed in claim 4, wherein the bracket is displaceably mounted on the container.

8. The device as claimed in claim 1, further comprising releasable securing means that are configured to fix the compressor and/or the plurality of individual parts of the multipart lifting device in the container.

9. The device as claimed in claim 8, wherein the releasable securing means are clamping blocks, straps, and/or screw connections.

10. The device as claimed in claim 1, wherein a plurality of roller elements are arranged on the container.

11. The device as claimed in claim 10, wherein the plurality of roller elements are arranged on the removable side element.

12. The device as claimed in claim 10, wherein at least one of the plurality of roller elements is pivotably mounted.

13. The device as claimed in claim 1, wherein the fastening device is adjustable along the support frame.

14. The device as claimed in claim 1, wherein the fastening device is longitudinally adjustable along the support frame.

15. The device as claimed in claim 1, wherein a linear or angled extension arm is fastened to the fastening device.

16. The device as claimed in claim 1, wherein the support frame comprises a plurality of fastening devices which are able to be adjusted in a horizontal plane.

17. The device as claimed in claim 16, wherein three or four fastening devices are able to be adjusted in the horizontal plane.

* * * * *